US011655011B2

(12) United States Patent
Scheepers

(10) Patent No.: US 11,655,011 B2
(45) Date of Patent: May 23, 2023

(54) SNORKEL WITH BUOYANT SUPPORT

(71) Applicant: Anthony Scheepers, Victoria (CA)

(72) Inventor: Anthony Scheepers, Victoria (CA)

( * ) Notice: Subject to any disclaimer, the term of this patent is extended or adjusted under 35 U.S.C. 154(b) by 108 days.

(21) Appl. No.: 15/926,922

(22) Filed: Mar. 20, 2018

(65) Prior Publication Data

US 2018/0327064 A1 Nov. 15, 2018

Related U.S. Application Data

(60) Provisional application No. 62/506,540, filed on May 15, 2017.

(51) Int. Cl.
*B63C 11/20* (2006.01)
*B63C 11/18* (2006.01)

(52) U.S. Cl.
CPC ..... *B63C 11/207* (2013.01); *B63C 11/186* (2013.01)

(58) Field of Classification Search
CPC ..... B63C 11/16; B63C 11/18; B63C 11/186; B63C 11/20; B63C 11/205; B63C 11/207
USPC ..... 128/202.13, 202.14, 201.11; 137/512, 137/908
See application file for complete search history.

(56) References Cited

U.S. PATENT DOCUMENTS 908,690 A * 1/1909 Neubert ..... B63C 11/207 128/201.11
4,583,536 A * 4/1986 Jan ..... B63C 11/207 128/201.11
5,622,165 A * 4/1997 Huang ..... B63C 11/207 128/201.11
2009/0078259 A1* 3/2009 Kooij ..... A61M 16/0875 128/205.25

* cited by examiner

*Primary Examiner* — Elliot S Ruddie
(74) *Attorney, Agent, or Firm* — Orin Del Vecchio

(57) ABSTRACT

The present invention comprises a snorkel, comprising a breathing hose, the breathing hose having a mouthpiece at one end and connected to a buoyant rigid body at the other end, the rigid body comprising an internal cavity, with the breathing hose connected to the internal cavity; a first opening into the internal cavity disposed at a top end of the rigid body, the first opening having a first cover with a diameter greater than the diameter of the opening, and the first cover extending over the first opening; and a weighted ring secured to a bottom end of the rigid body, the weighted ring surrounding the end of the breathing hose connected to the rigid body, wherein the breathing tube and the first opening define an airway permitting a user to breathe through the snorkel.

10 Claims, 5 Drawing Sheets

SNORKEL WITH BUOYANT SUPPORT

FIELD OF THE INVENTION

The present specification relates generally to snorkels and, in particular, to a snorkel with an integrated buoyant support.

BACKGROUND OF THE INVENTION

Snorkeling is a common recreational activity for both adults and children. A snorkel generally consists of a breathing tube and mouthpiece connected to a transparent swim mask or goggles. The breathing tube extends above the surface of the water when the user places their face with the mouthpiece below the surface. Thus, the user can explore and see objects underwater without have to break the surface to breath.

However, the user must exercise caution to avoid bringing the end of the breathing tube below the surface of the water, which would compromise the airway and pose a dangerous safety hazard to the user. Particularly when the snorkel tube is rigidly attached to the mask or goggle assembly, then as the user descends or turns, it may be relatively easy for the user to inadvertently pull the end of the breathing tube below the surface of the water. Another potential risk is water splashing into the breathing tube and interfering with the user's breathing, especially when snorkeling in bodies of water with waves or ripple effects, as in oceans and lakes.

It would be preferable to provide a snorkel with a reduced risk of inadvertent tube flooding. It would also be preferable to provide a snorkel that enables the user to operate with a greater degree of freedom of movement without concern for the position and movement of the breathing tube.

Accordingly, there remains a need for improvements in the art.

SUMMARY OF THE INVENTION

In accordance with an aspect of the invention, there is provided a snorkel with a buoyant support.

According to an embodiment of the invention there is provided a snorkel, comprising a breathing hose, the breathing hose having a mouthpiece at one end and connected to a buoyant rigid body at the other end, the rigid body comprising an internal cavity, with the breathing hose connected to the internal cavity; a first opening into the internal cavity disposed at a top end of the rigid body, the first opening having a first cover with a diameter greater than the diameter of the opening, and the first cover extending over the first opening; and a weighted ring secured to a bottom end of the rigid body, the weighted ring surrounding the end of the breathing hose connected to the rigid body, wherein the breathing tube and the first opening define an airway permitting a user to breathe through the snorkel.

Additionally, the snorkel may further comprise a tube disposed within the internal cavity, the tube connected to the breathing hose at one end, and having a second opening inside the internal cavity, the second opening having a second cover with a diameter greater than the diameter of the second opening, and the second cover extending over the second opening, wherein the breathing hose, the first opening and the second opening define an airway permitting the user to breathe through the snorkel According to another embodiment of the invention, there is provided a buoyant support attachment for a snorkel, comprising a rigid body with an internal cavity, with a connection at the base of the rigid body permitting a breathing hose to be connected to the internal cavity; a first opening into the internal cavity disposed at a top end of the rigid body, the first opening having a first cover with a diameter greater than the diameter of the opening, and the first cover extending over the first opening; and a weighted ring secured to a bottom end of the rigid body, the weighted ring surrounding the end of the breathing hose connected to the rigid body, wherein the first opening and the breathing hose define an airway for the user.

Additionally, the buoyant support may further comprise: a tube disposed within the internal cavity, the tube connected to the breathing hose at one end, and having a second opening inside the internal cavity, the second opening having a second cover with a diameter greater than the diameter of the second opening, and the second cover extending over the second opening, wherein the breathing hose, the first opening and the second opening define an airway permitting the user to breathe through the snorkel.

Other aspects and features according to the present application will become apparent to those ordinarily skilled in the art upon review of the following description of embodiments of the invention in conjunction with the accompanying figures.

BRIEF DESCRIPTION OF THE DRAWINGS

Reference will now be made to the accompanying drawings which show, by way of example only, embodiments of the invention, and how they may be carried into effect, and in which.

Like reference numerals indicated like or corresponding elements in the drawings.

DETAILED DESCRIPTION OF THE EMBODIMENTS

Figure 1:
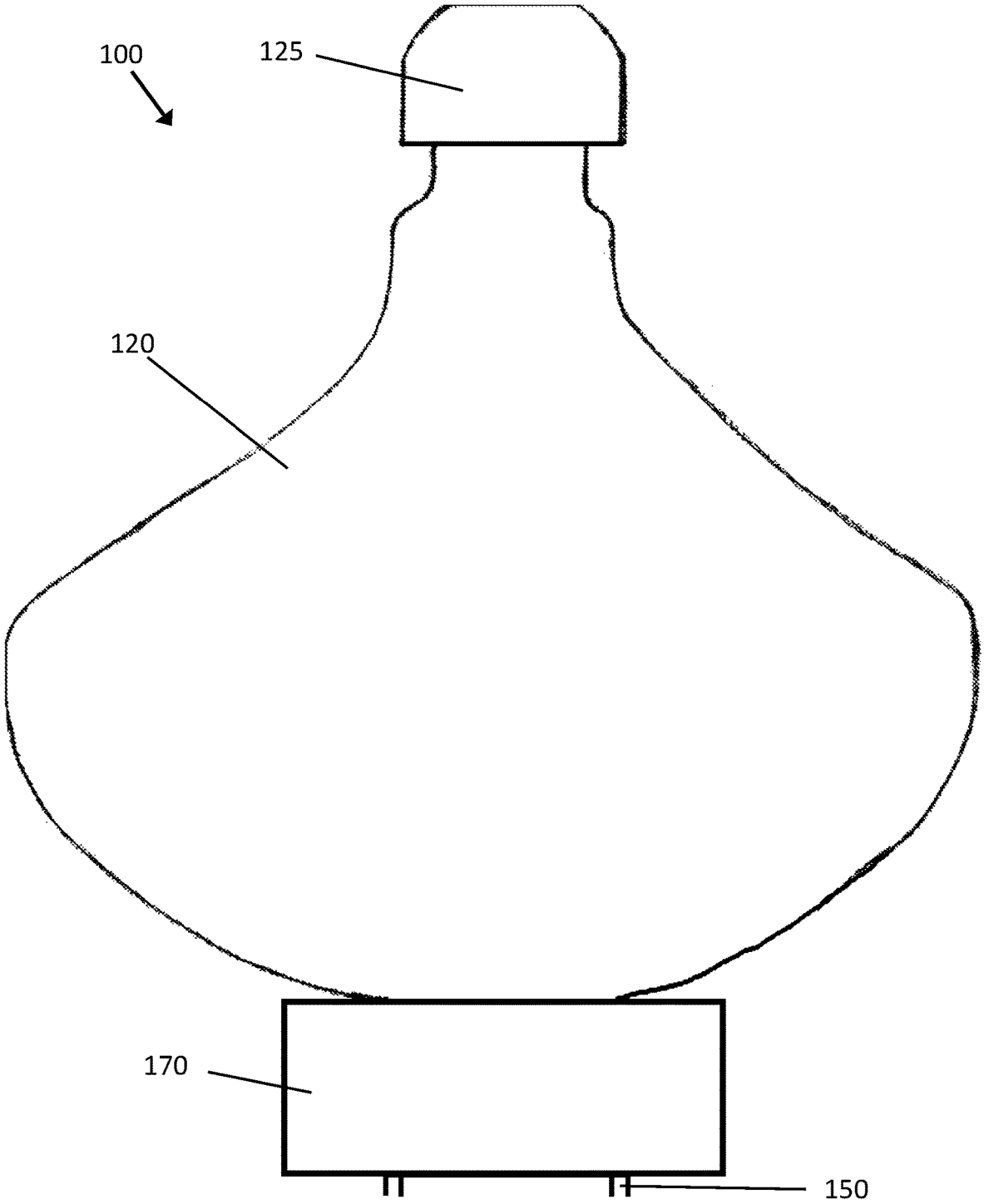
FIG. 1 is a side view of a rigid body for a snorkel according to an embodiment.
Figure 2:
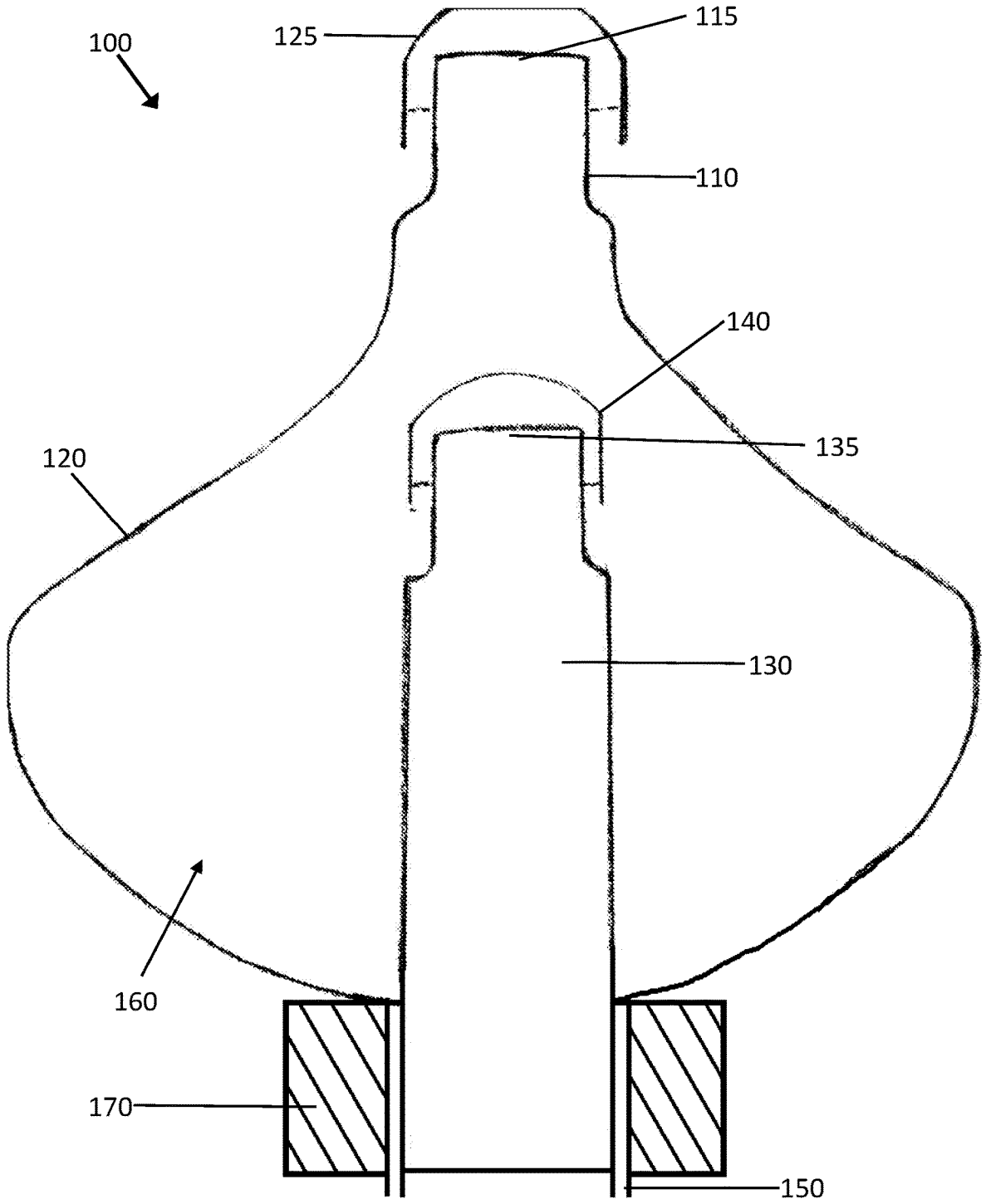
FIG. 2 is a cut-away view of FIG. 1 along line A-A.

The present invention relates to snorkels, and in particular, to a snorkel with an integrated buoyant support to maintain the opening of the snorkel above the surface of the body of water in which the user is snorkeling.

According to an embodiment as shown in FIGS. 1-4, snorkel 100 may be formed from a rigid body 120 in a substantially bulbous shape with the top of the body having a narrow section 110 with an opening 115 to permit the passage of air. Opening 115 is surmounted by a cover 125, which has a diameter greater than that of opening 115 and extends partially over the narrow section 110. The base of rigid body 120 is wider than the top, for increased buoyancy and to permit flotation such that opening 115 remains above the water line while in use. Rigid body 120 may further include a tube 130 which extends upwards into the internal cavity 160 of rigid body 120. Tube 130 has an opening 135 to permit the passage of air, and a cover 140, which has a diameter greater than that of opening 135 and extends partially over tube 130. The hollow internal cavity 160 enables rigid body 120 to float on the surface of water.

Tube 130 is coupled to a flexible, extendible breathing hose 150, which is then coupled to a mouthpiece 155 to enable the user to breathe through the snorkel 100. A weighted ring 170 is secured to the base of rigid body 120 around the tube 130 and/or breathing hose 150 to maintain rigid body 120 in an upright position while floating in water, keeping opening 115 above the waterline.

Figure 3:
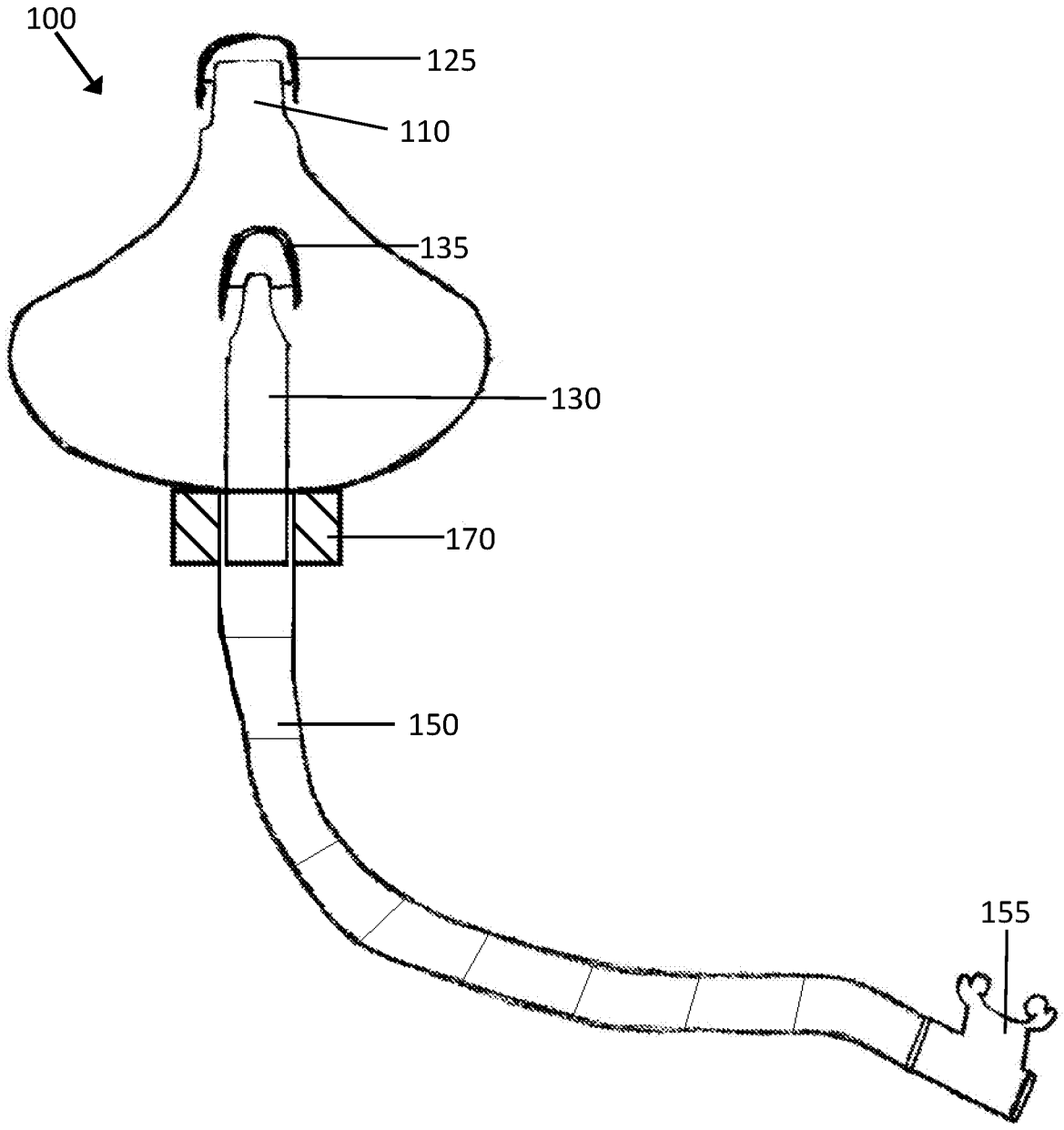
FIG. 3 is a cut-away view of a snorkel according to an embodiment with a breathing hose at full extension.
Figure 4:
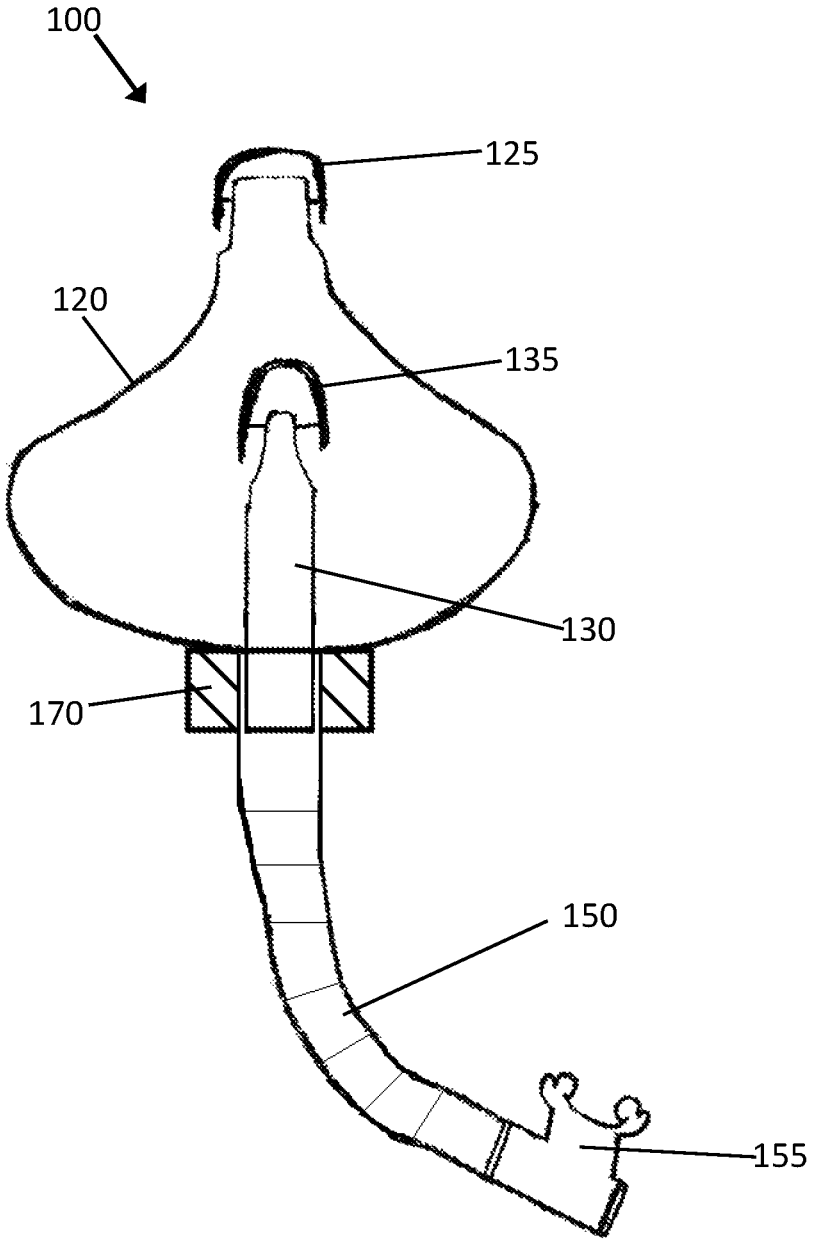
FIG. 4 is a cut-away view of the snorkel of FIG. 3 with the breathing hose at minimum extension.

Breathing hose 150 may be both flexible and extendible, to enable freedom of movement underwater for the user while snorkeling. The maximum extension of breathing hose 150 is limited by the maximum recommended snorkeling depth (around 36 inches underwater), accounting for some movement, and the minimum extension is limited by the materials used. For example, a breathing hose formed from flexible plastic with an internal wire coil for extension/compression may have a maximum extension of 40 inches and a minimum extension of 10 inches. FIGS. 3 and 4 show the snorkel 100 with breathing hose at maximum and minimum extension, respectively.

The flexibility and extendibility of breathing tube 150 may permit the user to swim and change depth to a certain extent without interface from snorkel 100 and with a reduced concern of overcoming the resistance of the buoyancy of rigid body 120 and pulling the opening 115 under the surface of the water.

The mouthpiece 155 may be formed from two one-way air valves, such that the user breathes in oxygenated air through one valve engaged with breathing hose 150 and expels carbon dioxide contaminated air through the other valve into the water. Using two valves reduces carbon dioxide buildup in the breathing hose, which permits longer submersion without loss of oxygen. In an embodiment, the mouthpiece may be formed from a rigid body with a softer bite plate (e.g. silicone), and the valve connecting to the breathing hose 150 located at the top of the mouthpiece and the other valve at the bottom of the mouthpiece.

Figure 5:
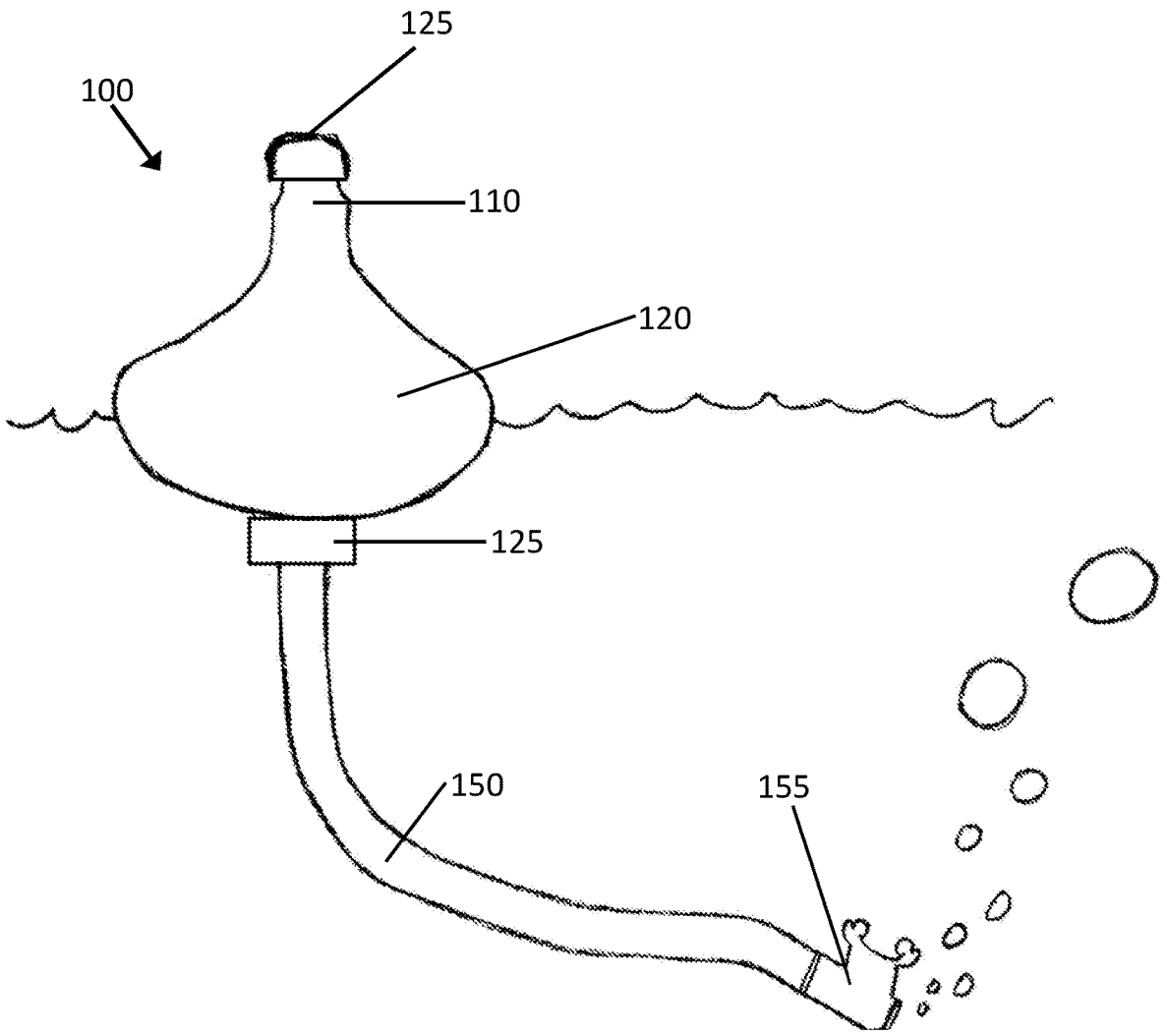
FIG. 5 is a simulated perspective view of the snorkel of FIG. 3 in use.

When snorkel 100 is in use, as shown in the simulated view in FIG. 5, rigid body 120 floats on the surface of the water, with breathing hose 150 extending under the water. Weighted ring 170 assists to hold rigid body 120 in an upright position, keeping opening 115 (covered by cover 125) above the surface of the water and permitting the user to breathe. Cover 125 generally inhibits water from entering opening 115 via splashing or wave movement or other incidents. If water does penetrate through opening 115, cover 140 protects opening 135, acting as a failsafe to prevent the user from breathing in water. Additionally, the cavity 160 of rigid body 120 may hold a small amount of water without compromising its buoyancy characteristics.

The snorkel 100 may be used on its own, or with swim goggles or a diving mask. By detaching the snorkel from a mask or similar equipment, the user may be provided with greater freedom of movement while snorkeling, as well as a reduced risk of inadvertently flooding the openings 115 and 135 during movement. Alternatively, breathing hose may include clips or straps near mouthpiece 155 to permit it to be secured to a diving mask or equivalent. Where such clips are included, breathing hose 150 may be rigid (i.e. non-extendible) at that point.

The dimensions of snorkel 100 and the components may vary, depending on construction materials, and intended use by an adult or child. In the embodiment herein, for an adult-sized snorkel, rigid body 120 may be eight inches in height, with a 1.5-inch external diameter (a 1.25-inch internal diameter) for opening 115, and a 3-inch maximum diameter. As discussed above, mouthpiece 155 may be formed with two one-way air valves, such that the user breathes oxygenated air in through one valve through the snorkel 100 and expels carbon dioxide contaminated air through the other valve into the water.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description and all changes which come within the meaning and range of equivalency of the claims are therefore intended to be embraced therein.

What is claimed is:

1. A snorkel, comprising:

a breathing hose, the breathing hose having a mouthpiece at one end and connected to a buoyant rigid body at the other end, the rigid body comprising:

an internal cavity, with the breathing hose connected to the internal cavity;

a first opening into the internal cavity disposed at a top end of the rigid body, the first opening having a first cover with a diameter greater than the diameter of the opening, and the first cover extending over the first opening;

a tube disposed within the internal cavity, the tube connected to the breathing hose at one end, and having a second opening inside the internal cavity, the second opening having a second cover with a diameter greater than the diameter of the second opening, and the second cover extending over and covering the second opening, and a weighted ring secured to a bottom end of the rigid body, the weighted ring surrounding the end of the breathing hose connected to the rigid body, wherein the breathing tube, the first opening and the second opening are aligned along a central longitudinal axis of the rigid body to define an airway permitting a user to breathe through the snorkel.

2. The snorkel of claim 1, wherein the diameter of first opening and the diameter of the second opening are identical.

3. The snorkel of claim 1, wherein the breathing hose is further extendible and retractable.

4. The snorkel of claim 3, wherein the minimum extension of the breathing hose is 10 inches and the maximum extension of the breathing hose is 40 inches.

5. The snorkel of claim 1, wherein the rigid body is bulb-shaped.

6. The snorkel of claim 1, wherein the mouthpiece is comprised of two one-way air valves, a first one-way air valve engaged with the breathing hose, and a second one-way air valve not directly connected to the breathing hose.

7. A buoyant support attachment for a snorkel, comprising:

a rigid body with an internal cavity, with a connection at a base of the rigid body permitting a breathing hose to be connected to the internal cavity;

a first opening into the internal cavity disposed at a top end of the rigid body, the first opening having a first cover with a diameter greater than the diameter of the opening, and the first cover extending over the first opening;

a tube disposed within the internal cavity, the tube connected to the breathing hose at one end, and having a second opening inside the internal cavity, the second opening having a second cover with a diameter greater than the diameter of the second opening, and the second cover extending over and covering the second opening, and a weighted ring secured to a bottom end of the rigid body, the weighted ring surrounding an end of the breathing hose connected to the rigid body, wherein the first opening, the second opening and the breathing hose are aligned along a central longitudinal axis of the rigid body to define an airway for the user.

8. The buoyant support of claim 7, wherein the diameter of first opening and the diameter of the second opening are identical.

9. The buoyant support of claim 7, wherein the rigid body is bulb-shaped.

10. The buoyant support of claim 7, further comprising a mouthpiece for attachment to the breathing hose, the mouthpiece comprised of two one-way air valves, a first one-way air valve engaged with the breathing hose, and a second one-way air valve not directly connected to the breathing hose.

* * * * *